US008550452B2

(12) United States Patent
Nishioka

(10) Patent No.: US 8,550,452 B2
(45) Date of Patent: Oct. 8, 2013

(54) SHEET FEEDER AND IMAGE FORMING APPARATUS THEREWITH

(71) Applicant: Kyocera Document Solutions Inc., Osaka (JP)

(72) Inventor: Nobuhiro Nishioka, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 0 days.

(21) Appl. No.: 13/648,431

(22) Filed: Oct. 10, 2012

(65) Prior Publication Data

US 2013/0134657 A1 May 30, 2013

(30) Foreign Application Priority Data

Nov. 25, 2011 (JP) ..... 2011-257027

(51) Int. Cl.
*B65H 1/08* (2006.01)
*B65H 1/26* (2006.01)

(52) U.S. Cl.
USPC ..... 271/147; 271/157

(58) Field of Classification Search
USPC ..... 271/147, 157
See application file for complete search history.

(56) References Cited

U.S. PATENT DOCUMENTS

| | | | | |
|---|---|---|---|---|
| 2007/0001380 | A1* | 1/2007 | Kusumi | 271/157 |
| 2008/0029950 | A1* | 2/2008 | Wada et al. | 271/147 |
| 2011/0140347 | A1* | 6/2011 | Nishitani et al. | 271/157 |
| 2011/0260391 | A1* | 10/2011 | Sugimoto | 271/110 |

FOREIGN PATENT DOCUMENTS

| | | |
|---|---|---|
| JP | 2004-323125 | 11/2004 |
| JP | 2007-197204 | 8/2007 |
| JP | 2008-265981 | 11/2008 |

* cited by examiner

*Primary Examiner* — David H Bollinger
(74) *Attorney, Agent, or Firm* — Morgan, Lewis & Bockius LLP

(57) ABSTRACT

A sheet feeder has a sheet accommodating portion, a lift plate, an actuating plate, and an actuating plate driving member. The lift plate is supported on the bottom face of the sheet accommodating portion such that an end part of the lift plate is rotatable. The actuating plate raises and lowers the lift plate by moving between a first position where it lies flat along the bottom face of the sheet accommodating portion and a second position where it is raised a predetermined angle from the bottom face of the sheet accommodating portion. The actuating plate driving member has the actuating plate fixed thereto. The engagement portion is provided on the reverse face of the lift plate, and engages with the actuating plate when this is in the first position and disengages from the actuating plate as the actuating plate rotates from the first position to the second position.

12 Claims, 6 Drawing Sheets

SHEET FEEDER AND IMAGE FORMING APPARATUS THEREWITH

INCORPORATION BY REFERENCE

This application is based on and claims the benefit of priority from Japanese Patent Application No. 2011-257027 filed on Nov. 25, 2011, the contents of which are hereby incorporated by reference.

TECHNICAL BACKGROUND

The present disclosure relates to a sheet feeder used to stock a large number of sheets such as sheets of paper to be supplied to an apparatus, and relates also to an image forming apparatus incorporating such a sheet feeder.

Sheet feed cassettes are used in image forming apparatuses as exemplified by copier and printers for the purpose of feeding sheets of cut paper. A sheet feed cassette stocks a large number of unprinted sheets of paper and feeds them one by one separately from the topmost layer of the sheets stacked inside the cassette.

Some sheet feed cassettes are provided with a lift plate on the top face of which sheets are placed. The lift plate is, at its upstream-side end with respect to the sheet feed direction, supported on the inner bottom face of the cassette body, and is rotatable about this pivoted end, with a downstream-side end part of the lift plate with respect to the sheet feed direction acting as a rotatable end. The rotatable end of the lift plate is raised by a driving means, such as a lift motor provided in an image forming apparatus, and a biasing means, such as a spring. This permits the downstream-side end of the sheets placed on the lift plate to be moved to a proper sheet feed position, and thereby enables stable sheet feeding.

As described above, the lift plate is, at its upstream-side end with respect to the sheet feed direction, supported so as to be rotatable about this pivoted end, with the downstream-side end of the lift plate acting as a rotatable end. Thus, when the image forming apparatus is transported with the sheet feed cassette loaded in it, vibration or impact may cause the lift plate to rotate. This inconveniently leads to the lift plate colliding with a member nearby, causing damage to the lift plate itself or to the member nearby.

As a solution, a sheet feed cassette is known which is provided with an engaged portion provided on a lift plate, a locking member provided on a cassette body, a biasing means for biasing the locking member in a direction for engagement with the engaged portion, and a locking member controlling means for moving the locking member in an unlocking direction by moving the lift plate in a direction for a flat-lying direction and for permitting the biasing member to move the locking member in a direction for engagement with the engaged portion when the lift plate is in a flat-lying position.

Also known is a sheet feeding device which includes a lift plate fixing member. This member can be put through a lift hole formed through a lift plate and through a locking hole provided in an accommodating face opposite it, has at its lower end an engagement projection that engages with the reverse face of the accommodating face when the member is put through those holes, and has in an upper part thereof a pressing piece that locks the top face of the lift plate.

Further known is a sheet feed cassette wherein, by moving in the axial direction a lift plate swinging shaft provided with a lift plate raising plate, an engagement portion provided on the reverse face of a lift plate and the lift plate raising plate are engaged with each other and thereby the lift plate is locked so as not to swing.

Inconveniently, however, the configuration provided with an engaged portion, a locking member, and a locking member controlling means requires the separate provision of the locking member and a compression spring (biasing means) for biasing the locking member, and also requires a complicated construction where the lift plate needs to be provided with a locked portion (engaged portion) and the image forming apparatus body needs to be provided with an unlocking projection. Moreover, this technology is directed to a configuration where a lift plate is biased in a rising direction by an elastic basing member, and is difficult to apply to a configuration where a lift plate is raised and lowered by use of a lift motor and an actuating plate.

On the other hand, the configuration including a lift plate fixing member requires the fitting of the lift plate fixing member before transport and the removal of the lift plate fixing member before use, spoiling ease of handling. Moreover, failure to fit or remove the lift plate fixing member may lead to damage to the lift plate. Furthermore, the need for a dedicated fixing member results in higher cost. The method involving locking the lift plate so as not to swing by use of a lift plate swinging shaft requires the lift plate swinging shaft to be moved in the axial direction to lock or unlock the rotation of the lift plate, resulting in a complicated configuration.

Although the foregoing discusses sheet feed cassettes that stock sheets of paper as a recording medium to feed them to an image forming section, similar problems are encountered with automatic document feeders that stock a stack of sheets of a document to feed them one by one to an image reading portion so long as they are so configured as to raise and lower a lift plate by use of a lift motor and an actuating plate.

SUMMARY

The present disclosure is directed to sheet feeders that stock and feed a large number of sheets of paper or a document, and aims to provide a sheet feeder that can, with a simple configuration, prevent rotation of a lift plate and the resulting damage to the lift plate and to a member nearby during the transport of an image forming apparatus, and to provide a highly practical image forming apparatus incorporating such a sheet feeder.

According to one aspect of the present disclosure, a sheet feeder is provided with a sheet accommodating portion, a lift plate, an actuating plate, and an actuating plate driving member. The sheet accommodating portion accommodates sheets. The lift plate is supported on the bottom face of the sheet accommodating portion such that an end part of the lift plate on the upstream side with respect to the sheet feed direction acts as a rotation pivot, and on the top face of the lift plate, the sheets are placed. The actuating plate raises and lowers the lift plate by moving between a first position where it lies flat along the bottom face of the sheet accommodating portion while in contact with, from below, an end part of the lift plate on the downstream side with respect to the sheet feed direction and a second position where it is raised a predetermined angle from the bottom face of the sheet accommodating portion. The actuating plate driving member has the actuating plate fixed to it, and has one end coupled to a raising/lowering member provided in an image forming apparatus body. The engagement portion is provided on the reverse face of the lift plate, and engages with the rotating-side edge of the actuating plate when the actuating plate is in the first position and disengages from the rotating-side edge of the actuating plate as the actuating plate rotates from the first position to the second position.

Other objects of the present disclosure and specific benefits obtained according to the present disclosure will become clearer from the following description of preferred embodiments.

DETAILED DESCRIPTION OF PREFERRED EMBODIMENTS

Figure 1:
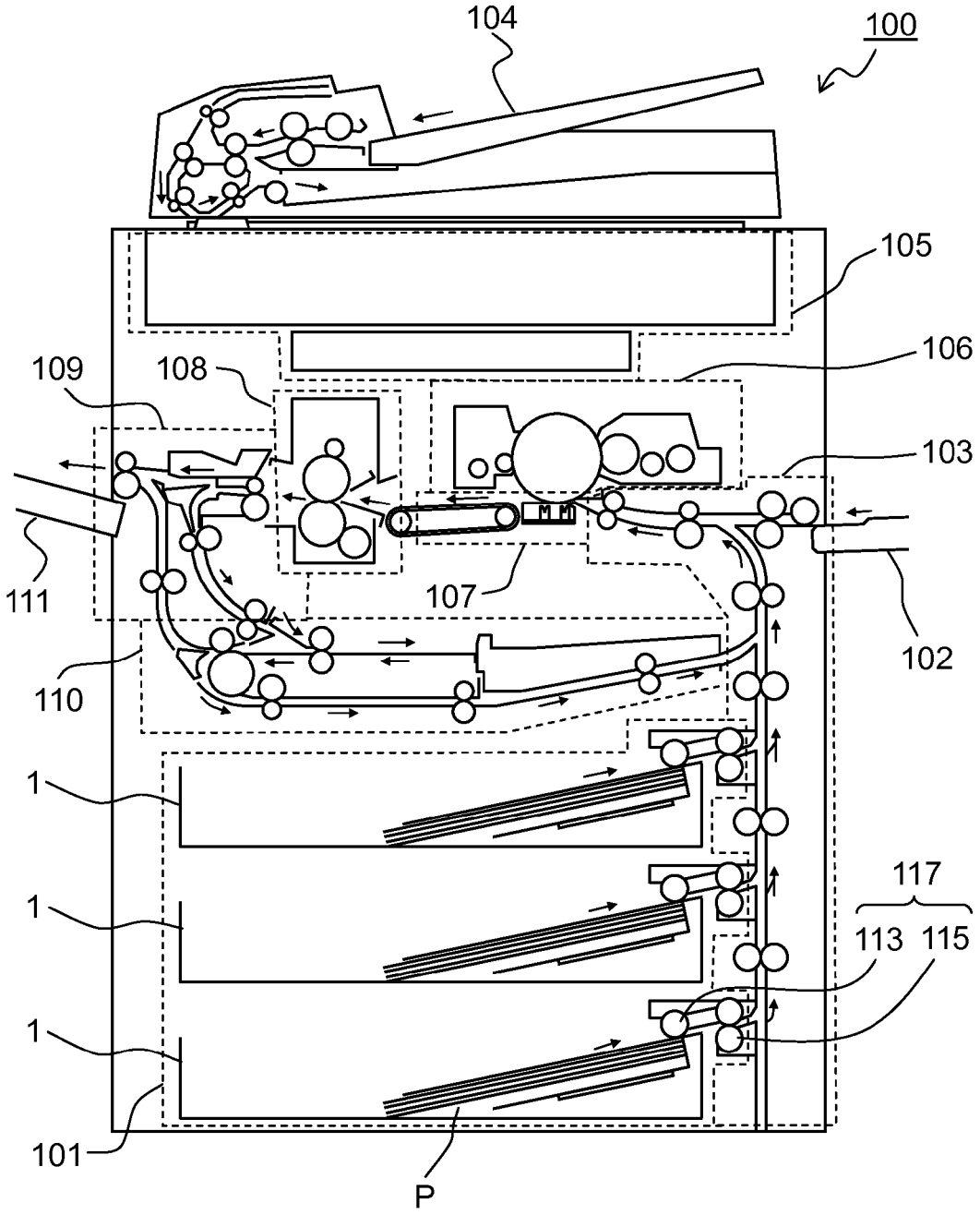
FIG. 1 is a side sectional view showing the internal construction of an image forming apparatus 100 incorporating a sheet feed cassette 1 according to the present disclosure.

Hereinafter, embodiments of the present disclosure will be described with reference to the accompanying drawings. FIG. 1 is a side sectional view showing the internal construction of an image forming apparatus 100 incorporating a sheet feed cassette 1 according to one embodiment of the disclosure. In the figure, solid-line arrows indicate the sheet transport path and the sheet transport direction.

In FIG. 1, in a lower part of the image forming apparatus 100, a cassette-type sheet feeding section 101 is arranged. The cassette-type sheet feeding section 101 is provided with a plurality of (here, three) sheet feed cassettes 1. Inside the sheet feed cassettes 1, sheets P such as sheets of unprinted cut paper are accommodated in a stacked state, and the sheets P are fed out one by one separately by a sheet feeding device 117 composed of a pickup roller 113 and a pair of sheet feed rollers 115.

A manual sheet feed section 102 is provided outside an upper part of the right side face of the image forming apparatus 100. The manual sheet feed section 102 is for placing thereon sheets P of different sizes and thicknesses from those accommodated in the cassette-type sheet feeding section 101 and printing media that are to be fed in sheet by sheet such as OHP sheets, envelopes, postcards, and invoices.

Inside the image forming apparatus 100, a sheet transport section 103 is arranged. The sheet transport section 103 is located on the downstream side of the cassette-type sheet feeding section 101 with respect to the sheet feed direction, that is, on its right, and is located on the downstream side of the manual sheet feed section 102 with respect to the sheet feed direction, that is, on its left. A sheet P fed out from the cassette-type sheet feeding section 101 is transported perpendicularly upward along a side face of the body of the image forming apparatus 100 by the sheet transport section 103. A sheet P fed out from the manual sheet feed section 102 is transported horizontally.

On the top face of the image forming apparatus 100, a document transporting device 104 is arranged, under which an image reading section 105 is arranged. When a user copies a document, he stacks on the document transporting device 104 a plurality of sheets of a document with images such as characters, figures, patterns, etc. on them. The document transporting device 104 feeds out the document sheet by sheet separately, and the image reading section 105 reads image data from them.

On the downstream side of the sheet transport section 103 with respect to the sheet feed direction, under the image reading section 105, there are arranged an image forming section 106 and a transfer section 107. In the image forming section 106, an electrostatic latent image of the document image is formed based on the image data read by the image reading section 105, and the electrostatic latent image is developed to form a toner image. On the other hand, in synchronism with the formation of the toner image in the image forming section 106, a sheet P is transported from the cassette-type sheet feeding section 101 through the sheet transport section 103 to the transfer section 107. The toner image formed in the image forming section 106 is transferred onto the sheet P in the transfer section 107.

On the downstream side of the transfer section 107, a fixing section 108 is arranged. The sheet P having the unfused toner image transferred on it in the transfer section 107 is transported to the fixing section 108, and passes through the nip between a pair of fixing rollers composed of a heating roller and a pressing roller. The unfused toner image on the sheet P is thereby fused and fixed to form a permanent image.

On the downstream side of the fixing section 108, near the left side face of the image forming apparatus 100, an eject/branch section 109 is provided. The sheet P discharged from the fixing section 108 is, unless two-sided printing is performed, ejected from the eject/branch section 109 onto a sheet ejection tray 111 provided outside the left side face of the image forming apparatus 100.

Under the image forming section 106 and the eject/branch section 109, over the cassette-type sheet feeding section 101, a two-sided printing unit 110 is arranged. When two-sided printing is performed, the sheet P discharged from the fixing section 108 is fed through the eject/branch section 109 into the two-sided printing unit 110. The sheet P fed into the two-sided printing unit 110 is turned over reverse face up by switchback transport, and is fed again through the sheet transport section 103, unprinted face up, to the transfer section 107.

Figure 2:
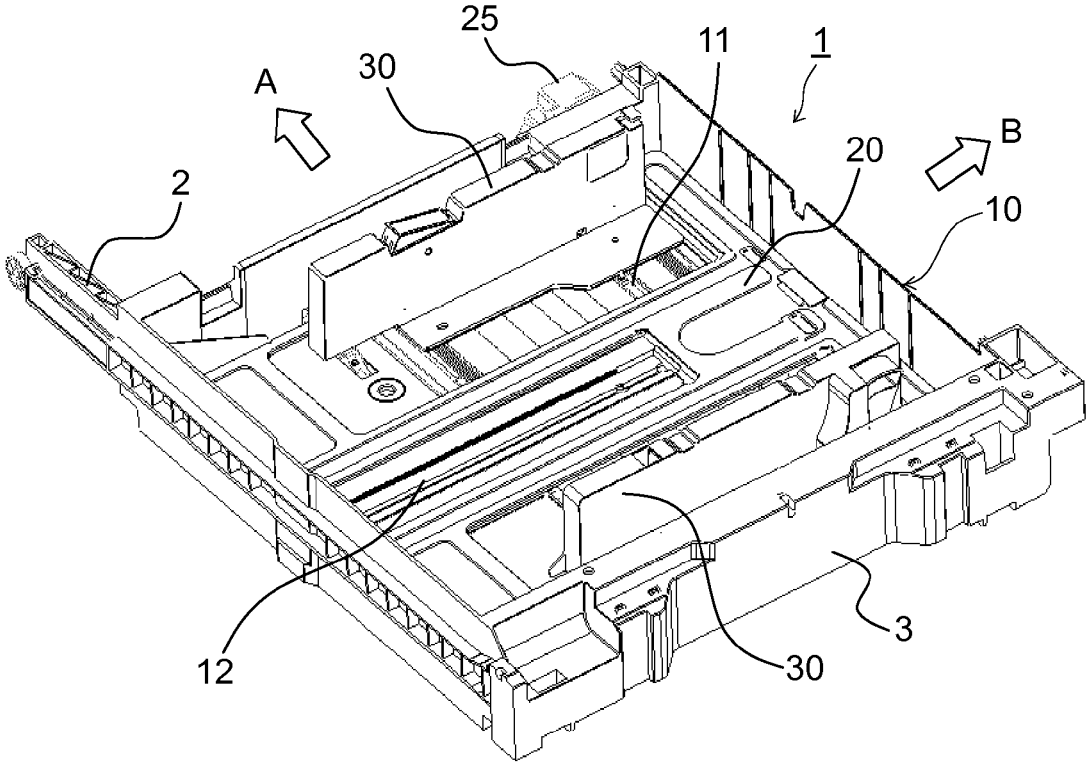
FIG. 2 is a perspective view, as seen from the upper-front side, of a sheet feed cassette 1 according to a first embodiment of the present disclosure.
Figure 3:
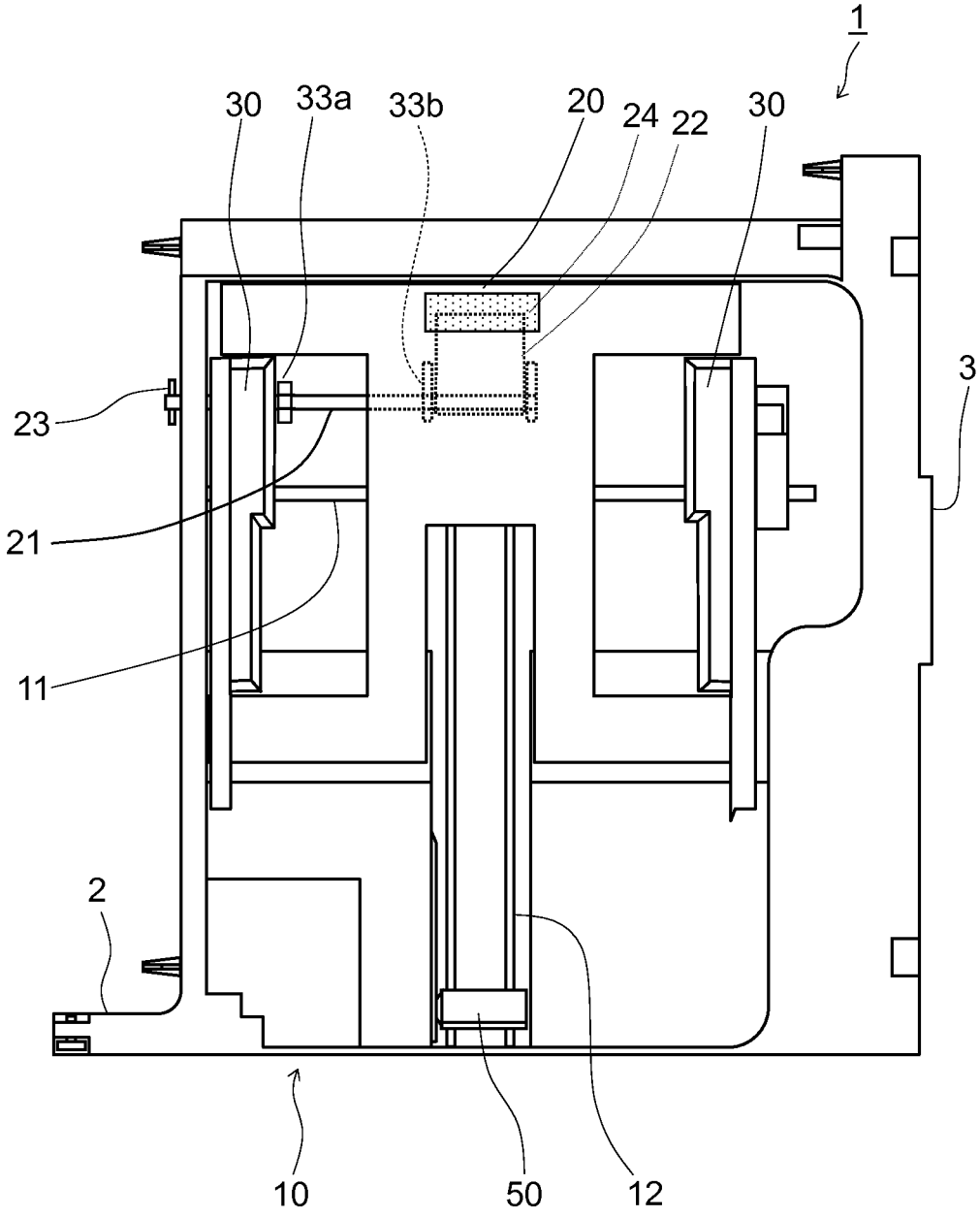
FIG. 3 is a plan view of the sheet feed cassette 1 according to the first embodiment.
Figure 4:
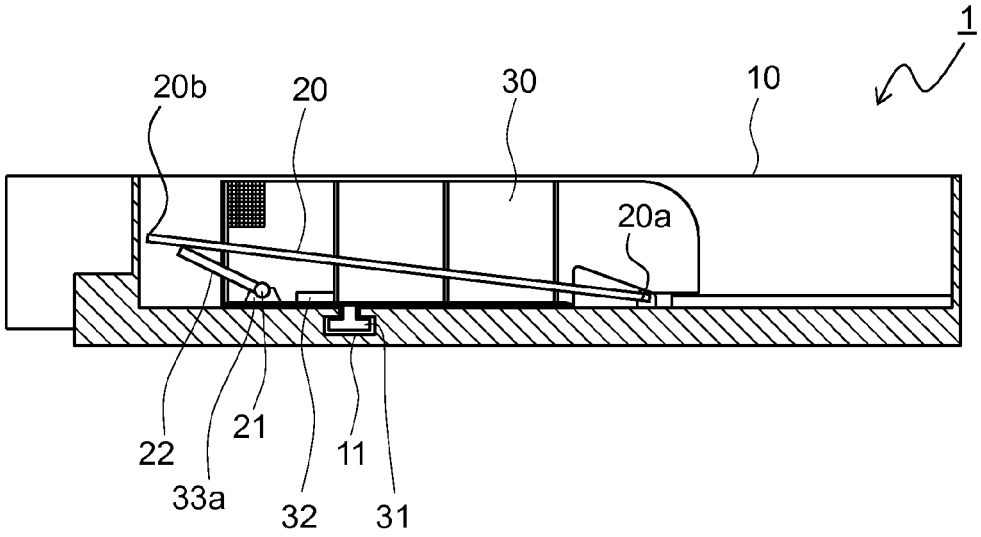
FIG. 4 is a side sectional view of the sheet feed cassette 1 according to the first embodiment.
Figure 5:
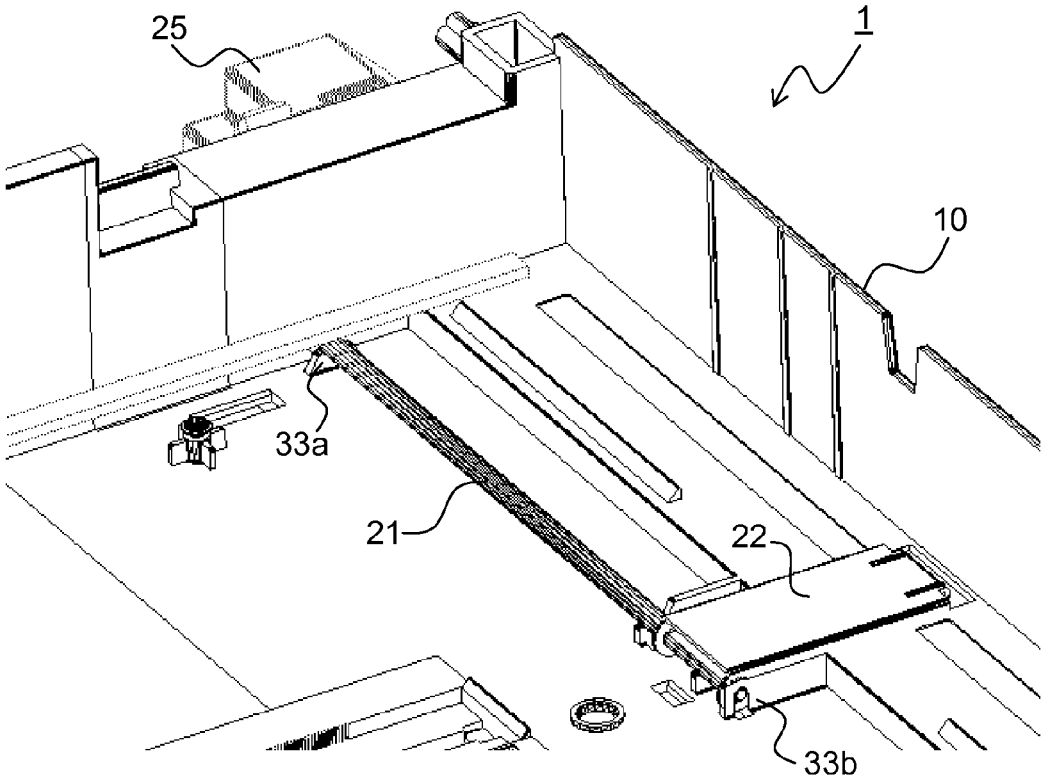
FIG. 5 is a perspective part view of and around an actuating plate 22 in the sheet feed cassette 1 according to the first embodiment.

Next, the details of the structure of the sheet feed cassette 1 according to the present disclosure will be described with reference to, in addition to FIG. 1, FIGS. 2 to 4. FIG. 2 is a perspective exterior view, as seen from the upper-front side, of a sheet feed cassette 1 according to a first embodiment of the present disclosure. FIG. 3 is a plan view of the sheet feed cassette 1 according to the first embodiment, FIG. 4 is a side sectional view of the sheet feed cassette 1 according to the first embodiment, and FIG. 5 is a perspective part view of and around an actuating plate 22 in the sheet feed cassette 1 according to the first embodiment. FIG. 5 shows a state with a lift plate 20 removed.

In FIG. 2, the sheet feed cassette 1 is housed in the cassette-type sheet feeding section 101 of the image forming apparatus 100 shown in FIG. 1. The loading of the sheet feed cassette 1 is achieved by first engaging a horizontal protrusion 2 provided on a side face of a cassette body 10 with an unillustrated rail provided inside the image forming apparatus 100 and then sliding the sheet feed cassette 1 horizontally in the direction indicated by arrow A in FIG. 2.

The cassette body 10 is configured in the shape of a flat box open at the top, and accommodates sheets stacked in it from above. Inside the image forming apparatus 100, the sheet feeding device 117 (see FIG. 1) is arranged over the sheet feed cassette 1, and sheets are fed out in the direction indicated by arrow B in FIG. 2. On the front face of the cassette body 10, an exterior cover 3 is formed integrally, and the exterior cover 3 forms a lower-front part of the housing of the image forming apparatus 100.

On the inner bottom face of the cassette body 10, a lift plate 20 is provided. Sheets are stacked on the lift plate 20. The lift plate 20 and the mechanism for raising and lowering it will be discussed later.

Inside the cassette body 10, a pair of width restricting cursors 30 is provided which rises upright and extends along the sheet feed direction (the direction indicated by arrow B). The width restricting cursors 30 make contact with side faces of the stack of sheets from opposite sides in the sheet width direction perpendicular to the sheet feed direction, and serve to position the sheets in the sheet width direction to keep them in the sheet feed position from which the sheet feeding device 117 feeds them out. The width restricting cursors 30 are movable along a width restricting cursor movement groove 11 which is provided in the inner bottom face of the cassette body 10 so as to extend in the sheet width direction.

As shown in FIG. 4, at the bottom of the width restricting cursors 30, a groove engagement portion 31 is provided, which engages with the width restricting cursor movement groove 11 formed in the bottom face of the cassette body 10 and thereby prevents the width restricting cursors 30 from coming off the cassette body 10. The pair of width restricting cursors 30, which makes contact with side faces of the stack of sheets from opposite sides in the sheet width direction, is so configured that, by the action of an unillustrated interlocking mechanism provided under them, moving one of them causes the other to move together. Here, the movement of the pair of width restricting cursors 30 is symmetric about the width-direction center line of the sheets.

Inside the cassette body 10, in an upstream-side part thereof with respect to the sheet feed direction, a trailing-end restricting cursor 50 is provided. The trailing-end restricting cursor 50 makes contact with a side face of the stack of sheets from the upstream side with respect to the sheet feed direction, and serves to position the sheets in the sheet feed direction to keep them in the sheet feed position from which the sheet feeding device 117 feeds them out. The trailing-end restricting cursor 50 is movable along a trailing-end restricting cursor movement groove 12 that is provided in the inner bottom face of the cassette body 10 so as to extend in the sheet feed direction. Like the width restricting cursors 30, the trailing-end restricting cursor 50 is, at the bottom, provided with an unillustrated groove engagement portion, which engages with the trailing-end restricting cursor movement groove 12 and thereby prevents the trailing-end restricting cursor 50 from coming off the cassette body 10.

The lift plate 20 is supported on the inner bottom face of the cassette body 10 so as to be rotatable about a rotation pivot 20*a* in an upstream-side end part of the lift plate 20 with respect to the sheet feed direction, and is thus rotatable up and down with a downstream-side end part of the lift plate 20 with respect to the sheet feed direction acting as a free end 20*b*. The lift plate 20 is a plate-form member, and has cuts formed in the movement regions of the width restricting cursors 30 and the trailing-end restricting cursor 50. On the top face of the lift plate 20, near its free end 20*b*, a friction member 24 is attached. The friction member 24 is a sheet-form member formed of a material, such as a cork, having a higher friction coefficient than the lift plate 20, and serves to prevent the stack of sheets placed on the top face of the lift plate 20 from gliding.

Under the lift plate 20, near its free end 20*b*, an actuating plate driving shaft 21 is arranged. The actuating plate driving shaft 21 is rotatably held on bearing portions 33*a* and 33*b* formed on the inner bottom face of the cassette body 10. One end of the actuating plate driving shaft 21 is put through fixing holes 22*a* (see FIG. 6) in the actuating plate 22, and thereby the actuating plate driving shaft 21 and the actuating plate 22 are fixed together. The actuating plate 22 is arranged in a position facing a substantially central part of the reverse face of the lift plate 20 in the sheet width direction.

The other end of the actuating plate driving shaft 21 is provided with a motor joint portion 23. The motor joint portion 23 protrudes out from a downstream-side side face (opposite from the exterior cover 3) with respect to the loading direction of the cassette body 10 into the image forming apparatus 100, and is coupled to a lift motor 25 provided in the image forming apparatus 100 when the sheet feed cassette 1 is loaded into the image forming apparatus 100. The motor joint portion 23 and the lift motor 25 constitute a raising/lowering member that is coupled to the actuating plate driving shaft 21 to raise and lower the actuating plate 22.

FIG. 4 shows a state where the free end 20*b* of the lift plate 20 is raised by the actuating plate 22. In a state where the motor joint portion 23 of the actuating plate driving shaft 21 is not coupled to the lift motor 25, the actuating plate 22 is in a position (first position) in which it lies flat along the bottom face of the cassette body 10, and the free end 20*b* of the lift plate 20 is lowered to its lowest position.

In the state where the actuating plate 22 is in the first position, the motor joint portion 23 is coupled to the lift motor 25. When the lift motor 25 is operated, the actuating plate driving shaft 21 rotates, and the actuating plate 22 rotates in the clockwise direction in FIG. 4. The rotating-side edge 22*b* (see FIG. 6) of the actuating plate 22 slides along the reverse face of the lift plate 20, and lifts the free end 20*b* of the lift plate 20, making it rise. Thus, the topmost layer of the sheets stacked on the lift plate 20 makes contact with the pickup roller 113 of the sheet feeding device 117 provided in the image forming apparatus 100, and the sheets are fed out one by one separately by the pair of sheet feed rollers 115 from the sheet feed cassette 1 to sheet transport section 103.

As the sheets stacked on the lift plate 20 are fed out, the amount by which the lift motor 25 is rotated is increased, and thus the angle between the bottom face of the cassette body 10 and the actuating plate 22 increases. When all the sheets P stacked on the lift plate 20 have been fed out, the actuating plate 22 is located at a position (second position) raised a predetermined angle from the bottom face of the cassette body 10, and the free end 20*b* of the lift plate 20 is raised to its highest position.

Here, in this embodiment, when the actuating plate 22 is in the first position, it is laid flat with its rotating-side edge 22*b* pointing to the downstream side with respect to the sheet feed direction (leftward in FIG. 4). This increases the distance between the contact portion (point of application) at which the rotating-side edge 22*b* makes contact with the lift plate 20 when the actuating plate 22 rotates to the second position and the rotation pivot 20*a* of the lift plate 20, and thus, by the law of the lever, reduces the force needed to lift the lift plate 20. This makes it possible to use an inexpensive low-torque motor as the lift motor 25.

Figure 6:
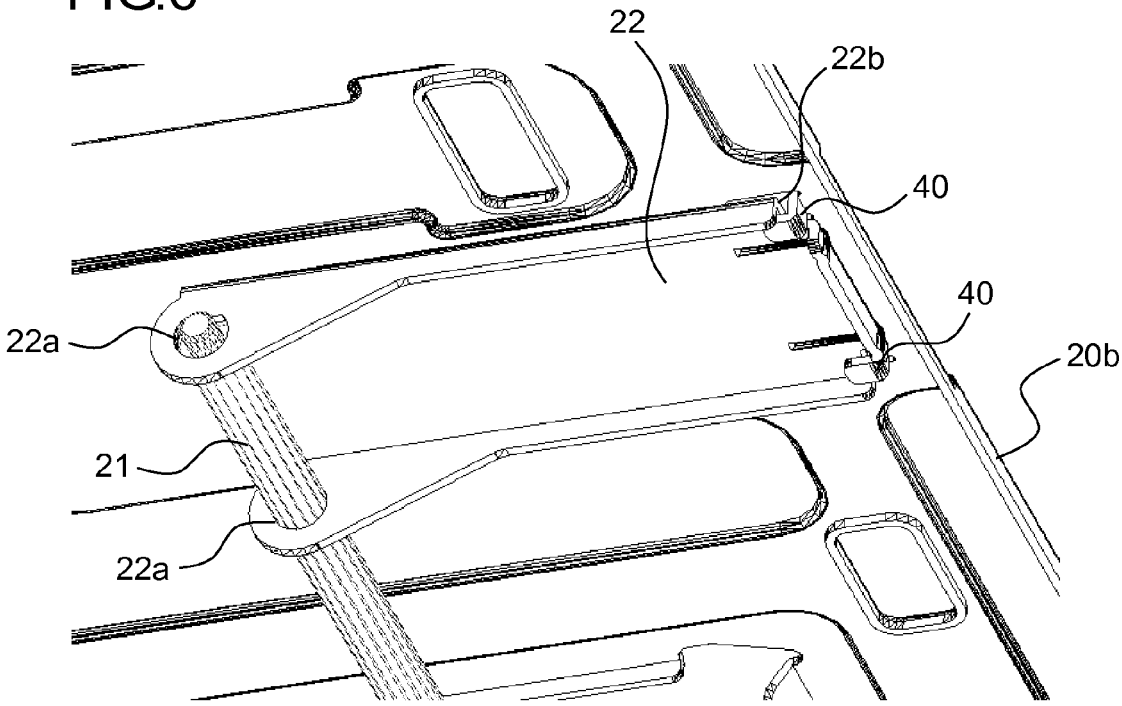
FIG. 6 is a perspective part view, as seen from the reverse face side, of the lift plate 20 as observed when the actuating plate 22 is in the first position.
Figure 7:
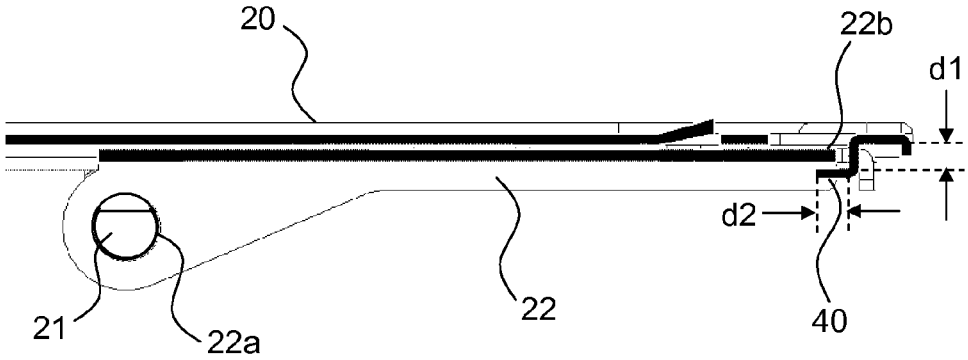
FIG. 7 is a side sectional view of the lift plate 20 and the actuating plate 22 as observed when the actuating plate 22 is in the first position.

FIG. 6 is a perspective part view, as seen from the reverse face side, of the lift plate 20 as observed when the actuating plate 22 is in the first position in the sheet feed cassette 1 according to the first embodiment. FIG. 7 is a side sectional view of the lift plate 20 and the actuating plate 22 in FIG. 6. How the actuating plate 22 locks and unlocks the lift plate 20 will now be described with reference to, in addition to FIGS. 2 to 5, FIGS. 6 and 7.

On the reverse face of the lift plate 20, near its free end 20*b*, a pair of engagement portions 40 are formed. The engagement portions 40 are, at their tip ends, bent toward the upstream side with respect to the sheet feed direction (leftward in FIG. 7) so as to be L-shaped. When the actuating plate 22 is in the first position, the rotating-side edge 22*b* of the actuating plate 22 engages with the tip ends of the engagement portions 40 by overlapping the tip ends from above. Thus, simply bringing the actuating plate 22 into the first position prevents the lift plate 20 from rising.

When the sheet feed cassette 1 with no sheets in it is loaded in the image forming apparatus 100, the actuating plate 22 is located in the first position, and the free end 20*b* of the lift plate 20 is lowered to its lowest position, and the motor joint portion 23 is coupled to the lift motor 25. Here, the actuating plate driving shaft 21 is coupled via the motor joint portion 23 to the lift motor 25, and therefore the actuating plate driving shaft 21 receives the rotating load of the lift motor 25.

The rotating load of the lift motor 25 continues acting on the actuating plate driving shaft 21 even when the power to the image forming apparatus 100 is off. For example, in a situation where the image forming apparatus 100 in use is transported or moved with the sheet feed cassette 1 loaded in it, first the power to the image forming apparatus 100 is turned off, then the sheet feed cassette 1 is unloaded from the body of the image forming apparatus 100 so that the motor joint portion 23 and the lift motor 25 are decoupled from each other and thereby the actuating plate 22 lowers to be located in the first position. Thereafter, when the sheet feed cassette 1 is loaded back in the image forming apparatus 100, the motor joint portion 23 and the lift motor 25 are coupled to each other, and the actuating plate driving shaft 21 receives the rotating load of the lift motor 25.

Accordingly, even under vibration or impact, the actuating plate 22 does not rotate out of the first position but maintains the state where the rotating-side edge 22*b* is engaged with the engagement portions 40. This restricts the upward rotation of the lift plate 20, and thereby prevents damage to the lift plate 20 itself and to a member nearby.

When the image forming apparatus 100 is used, while the power to the image forming apparatus 100 is on, loading the sheet feed cassette 1 having a stack of sheets placed on the lift plate 20 into the image forming apparatus 100 causes an unillustrated control section provided in the image forming apparatus 100 to detect the coupling between the motor joint portion 23 and the lift motor 25 and operate the lift motor 25.

As a result, from the state shown in FIGS. 6 and 7, the rotating-side edge 22*b* of the actuating plate 22 slides along the reverse face of the lift plate 20 so that the rotating-side edge 22*b* of the actuating plate 22 and the engagement portions 40 are automatically disengaged from each other, and the actuating plate 22 rotates a predetermined angle so that the free end 20*b* of the lift plate 20 is raised. Then, the topmost layer of the sheets stacked on the lift plate 20 makes contact with the pickup roller 113 of the sheet feeding device 117, and thus preparations for sheet feeding are made automatically. These preparations for sheet feeding through the operation of the lift motor 25 are automatically done in a similar manner also when power is turned on.

With the structure according to this embodiment, there is no need to add an extra member for locking the lift plate 20, and simply by loading the sheet feed cassette 1 into the image forming apparatus 100, it is possible to lock the lift plate 20 reliably on occasions where the image forming apparatus 100 is transported or moved. Moreover, by rotating the actuating plate 22 to the second position as commonly done during sheet feeding, it is possible to unlock the lift plate 20 automatically.

The distance d1 between the engagement portions 40 and the reverse face of the lift plate 20 and the amount of protrusion d2 of the engagement portions 40 in the downstream direction with respect to the sheet feed direction need to be set so that the actuating plate 22 can rotate out of the first position without the rotating-side edge 22*b* interfering with the engagement portions 40. The dimensions d1 and d2 can be set properly according to the distance between the swinging pivot of the lift plate 20 to its free end 20*b* (the rotation radius of the lift plate 20), the distance between the actuating plate driving shaft 21 and the rotating-side edge 22*b* of the actuating plate 22 (the rotation radius of the actuating plate 22), the thickness of the actuating plate 22, etc.

Figure 8:
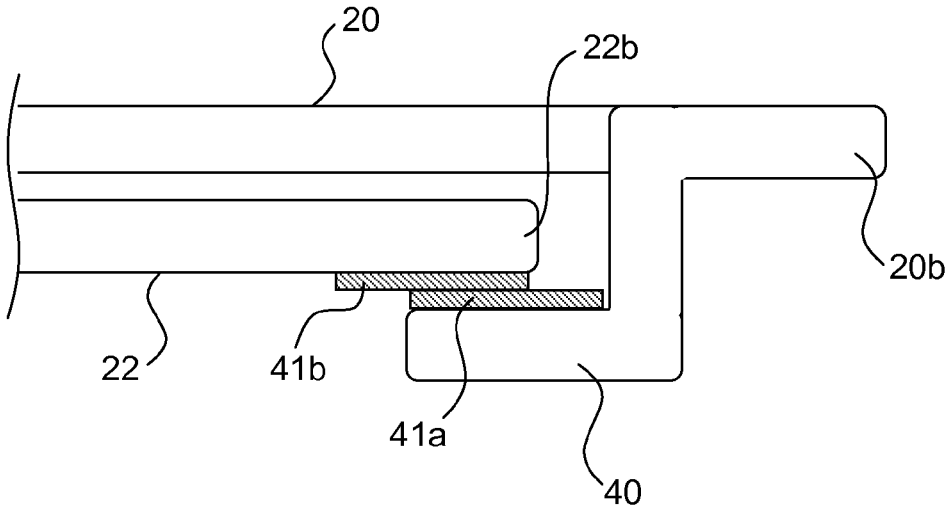
FIG. 8 is an enlarged sectional view of the contact portion between the engagement portions 40 of the lift plate 20 and the rotating-side edge 22*b* of the actuating plate 22 in a sheet feed cassette 1 according to a second embodiment of the present disclosure.

FIG. 8 is an enlarged sectional view of the contact portion between the engagement portions 40 of the lift plate 20 and the rotating-side edge 22*b* of the actuating plate 22 in a sheet feed cassette 1 according to a second embodiment of the present disclosure. In this embodiment, on the contact surfaces between the engagement portions 40 and the rotating-side edge 22*b* of the actuating plate 22, muffling members 41*a* and 41*b* are respectively attached. In other respects, the sheet feed cassette 1 is structured in a similar manner as in the first embodiment, and therefore no overlapping description will be repeated.

In the locked state where the engagement portions 40 and the rotating-side edge 22*b* are engaged with each other, there is no danger of the lift plate 20 rotating too far up. However, play in the engagement between the engagement portions 40 and the rotating-side edge 22*b*, play in the coupling between the motor joint portion 23 and the lift motor 25, or the like may cause the lift plate 20 and the actuating plate 22 to vibrate slightly when the image forming apparatus 100 is transported with the sheet feed cassette 1 loaded in. As a result, the engagement portions 40 and the rotating-side edge 22*b* come into and go out of contact repeatedly, producing impact sound.

With the structure according to this embodiment, since the muffling members 41*a* and 41*b* are attached to the contact surfaces between the engagement portions 40 and the rotating-side edge 22*b*, when the image forming apparatus 100 is transported with the sheet feed cassette 1 loaded in, it is possible to prevent noise (impact sounds) resulting from the vibration of the lift plate 20 and the actuating plate 22. As the muffling members 41*a* and 41*b*, a sheet-form elastic member can be used such as a rubber sheet or a sponge sheet.

Although here the muffling members 41*a* and 41*b* are attached to both of the contact surfaces between the engagement portions 40 and the rotating-side edge 22*b*, a muffling member 41*a* or 41*b* may be attached to either of the contact surfaces between the engagement portions 40 and the rotating-side edge 22*b*.

Figure 9:
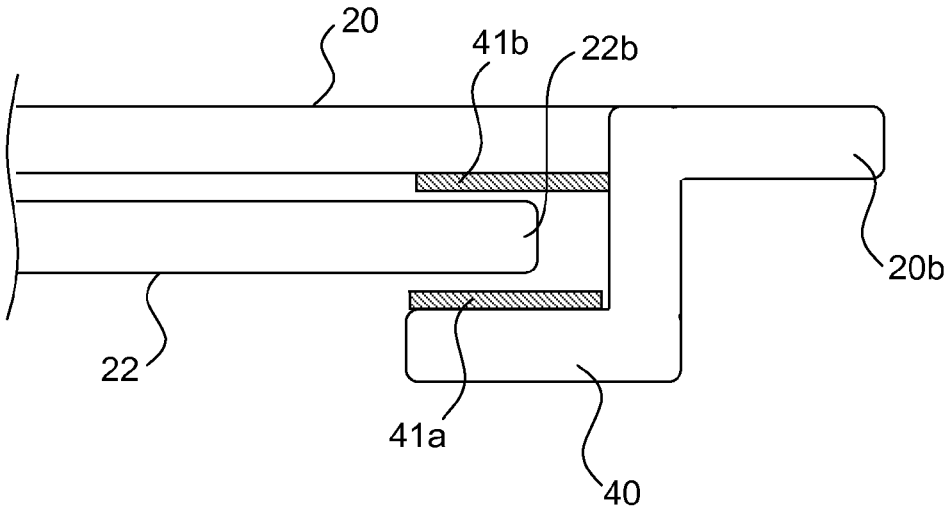
FIG. 9 is an enlarged sectional view of another configuration of the contact portion between the engagement portions 40 of the lift plate 20 and the rotating-side edge 22*b* of the actuating plate 22 in the sheet feed cassette 1 according to the second embodiment of the disclosure.

As shown in FIG. 9, the muffling member 41*b* may be attached to the reverse face of the lift plate 20. With this structure, the impact sound resulting from the actuating plate 22 vibrating up and down and making contact with the reverse face of the lift plate 20 can also be muffled effectively. The muffling member 41*b* may be attached to, instead of the reverse face of the lift plate 20, the contact surface (top face) of the rotating-side edge 22*b*.

The present disclosure is not limited to the embodiments specifically described above, and encompasses many modifications and variations without departing from the spirit of the present disclosure. For example, although the embodiments described above deal with examples where the engagement portions 40 are provided at two places so as to engage with left and right parts of the rotating-side edge 22*b* of the actuating plate 22, an engagement portion 40 may instead be provided at one place so as to engage with a central part of the actuating plate 22, or a wide engagement portion 40 may be provided so as to engage with the actuating plate 22 over its entire width. The engagement portions 40 may be shaped and configured in any other manner so long as they engage with the rotating-side edge 22*b* when the actuating plate 22 is in the first position and they disengage from the rotating-side edge 22*b* automatically when the actuating plate 22 rotates out of the first position.

With the structure described above where a pair of engagement portions 40 holds the rotating-side edge 22*b* of the actuating plate 22 from opposite sides, not only can the vibration of the lift plate 20 in the up/down direction be suppressed, its vibration in the front/rear direction (the direction perpendicular to the sheet feed direction) can also be suppressed to a certain extent.

Although the embodiments described above deal with examples where the actuating plate driving shaft 21 is used to couple the actuating plate 22 and the motor joint portion 23 together, instead of the actuating plate driving shaft 21, for example, a piece of sheet metal or the like bent in a square-cornered C-shape may be used. The actuating plate driving shaft 21 may be coupled to the motor joint portion 23 via a gear train so that the raising/lowering member for raising and lowering the actuating plate 22 is constituted by the gear train, the motor joint portion 23, and the lift motor 25. Instead, the actuating plate driving shaft 21 and the lift motor 25 may be coupled together by use of a gear train alone so that the raising/lowering member is constituted by the gear train and the lift motor 25.

Although the embodiments described above deal with a method of fixing a lift plate 20 in a sheet feed cassette 1 for feeding sheets to print on, it is not meant as any limitation. That is, by a similar method, it is possible to fix a lift plate in a document transporting device 104 (see FIG. 1) that feeds sheets of a document one by one. What is accommodated in the sheet feed cassette 1 is not limited to sheets of paper. Sheets of various printing media can be accommodated there, such as OHP sheets and label sheets. The present disclosure can be applied even to a method of fixing a lift plate in the manual feed section 102 (see FIG. 1) and in document transporting devices having no image forming section (scanners).

The present disclosure is applicable to sheet feeders that are unloadably loaded in an image forming apparatus and that make a lift plate rise and lower by use of a lift motor provided in the image forming apparatus. By use of the present disclosure, it is possible, more reliably than ever and with a simple structure, to lock a lift plate and stop transmitting a driving force and to unlock the lift plate and transmit a driving force, and thus it is possible to provide a sheet feeder that can prevent vibration of the lift plate during transport and thus damage to the lift plate and a member nearby resulting from vibration and that can prevent damage to the lift plate, its driving means, etc. during loading into an image forming apparatus.

What is claimed is:

1. A sheet feeder comprising:

a sheet accommodating portion which accommodates sheets;

a lift plate which is supported on a bottom face of the sheet accommodating portion such that an end part of the lift plate on an upstream side with respect to a sheet feed direction acts as a rotation pivot and on a top face of which the sheets are placed;

an actuating plate which raises and lowers the lift plate by moving between a first position where the actuating plate lies flat along the bottom face of the sheet accommodating portion while in contact with, from below, an end part of the lift plate on a downstream side with respect to the sheet feed direction and a second position where the actuating plate is raised a predetermined angle from the bottom face of the sheet accommodating portion;

an actuating plate driving member to which the actuating plate is fixed and of which one end is coupled to a raising/lowering member provided in an image forming apparatus body; and an engagement portion which is provided on a reverse face of the lift plate and which engages with a rotating-side edge of the actuating plate when the actuating plate is in the first position and disengages from the rotating-side edge of the actuating plate as the actuating plate rotates from the first position to the second position, wherein a muffling member is attached to at least one of contact surfaces between the engagement portion and the rotating-side edge of the actuating plate.

2. The sheet feeder according to claim 1, wherein when the actuating plate is in the first position, the actuating plate lies flat with the rotating-side edge thereof on the downstream side with respect to the sheet feed direction.

3. The sheet feeder according to claim 2, wherein the engagement portion is, at a tip end of the engagement portion, bent toward the upstream side with respect to the sheet feed direction so as to be L-shaped as seen in a side view, and the actuating plate, when in the first position, engages with the tip end of the engagement portion by overlapping the tip end from above.

4. The sheet feeder according to claim 1, wherein the engagement portion is so formed as to hold the rotating-side edge from opposite sides in a direction perpendicular to the sheet feed direction.

5. The sheet feeder according to claim 1, wherein the sheet accommodating portion is unloadably loaded in the image forming apparatus body, and when the sheet accommodating portion is unloaded from the image forming apparatus body, the actuating plate driving member and the raising/lowering member are decoupled from each other and the actuating plate is located in the first position.

6. An image forming apparatus comprising the sheet feeder according to claim 1.

7. A sheet feeder comprising:

a sheet accommodating portion which accommodates sheets;

a lift plate which is supported on a bottom face of the sheet accommodating portion such that an end part of the lift plate on an upstream side with respect to a sheet feed direction acts as a rotation pivot and on a top face of which the sheets are placed;

an actuating plate which raises and lowers the lift plate by moving between a first position where the actuating plate lies flat along the bottom face of the sheet accommodating portion while in contact with, from below, an end part of the lift plate on a downstream side with respect to the sheet feed direction and a second position where the actuating plate is raised a predetermined angle from the bottom face of the sheet accommodating portion;

an actuating plate driving member to which the actuating plate is fixed and of which one end is coupled to a raising/lowering member provided in an image forming apparatus body; and an engagement portion which is provided on a reverse face of the lift plate and which engages with a rotating-side edge of the actuating plate when the actuating plate is in the first position and disengages from the rotating-side edge of the actuating plate as the actuating plate rotates from the first position to the second position, wherein a muffling member is attached to at least one of opposite faces between the reverse face of the lift plate and the rotating-side edge of the actuating plate.

8. The sheet feeder according to claim 7, wherein the actuating plate, when in the first position, lies flat with the rotating-side edge thereof on the downstream side with respect to the sheet feed direction.

9. The sheet feeder according to claim 8, wherein the engagement portion is, at a tip end thereof, bent toward the upstream side with respect to the sheet feed direction so as to be L-shaped as seen in a side view, and the actuating plate, when in the first position, engages with the tip end of the engagement portion by overlapping the tip end from above.

10. The sheet feeder according to claim 7, wherein the engagement portion is so formed as to hold the rotating-side edge from opposite sides in a direction perpendicular to the sheet feed direction.

11. The sheet feeder according to claim 7, wherein the sheet accommodating portion is unloadably loaded in the image forming apparatus body, and when the sheet accommodating portion is unloaded from the image forming apparatus body, the actuating plate driving member and the raising/lowering member are decoupled from each other and the actuating plate is located in the first position.

12. An image forming apparatus comprising the sheet feeder according to claim 7.

* * * * *